US008195082B1

(12) United States Patent
King

(10) Patent No.: US 8,195,082 B1
(45) **Date of Patent: *Jun. 5, 2012**

(54) COLLATOR SYSTEM AND METHOD FOR COPY MACHINES

(75) Inventor: William C. King, Mecersberg, PA (US)

(73) Assignee: Tuscarora Designs, Inc, Mercersberg, PA (US)

( * ) Notice: Subject to any disclaimer, the term of this patent is extended or adjusted under 35 U.S.C. 154(b) by 522 days.

This patent is subject to a terminal disclaimer.

(21) Appl. No.: 12/387,890

(22) Filed: May 9, 2009

Related U.S. Application Data

(63) Continuation-in-part of application No. 11/311,713, filed on Dec. 20, 2005, now Pat. No. 7,532,851.

(60) Provisional application No. 60/652,810, filed on Feb. 15, 2005.

(51) Int. Cl.
*G03G 15/00* (2006.01)

(52) U.S. Cl. ..... 399/374; 399/380

(58) Field of Classification Search ..... 399/207, 399/374, 377, 365, 380
See application file for complete search history.

(56) References Cited

U.S. PATENT DOCUMENTS

| | | | | |
|---|---|---|---|---|
| 3,571,678 | A | 3/1971 | Sezako | 361/234 |
| 3,634,740 | A | 1/1972 | Stevko | 361/234 |
| 3,916,270 | A | 10/1975 | Wachtler | 361/234 |
| 4,721,981 | A | 1/1988 | Rauen et al. | 355/75 |
| 4,766,515 | A | 8/1988 | Bollen et al. | 361/234 |
| 4,975,802 | A | 12/1990 | Kasahari | 361/233 |
| 5,009,352 | A | 4/1991 | Yasuda | 226/94 |
| 5,022,640 | A | 6/1991 | Greco | 271/31 |
| 5,228,373 | A | 7/1993 | Welsch | 83/24 |
| 5,261,634 | A | 11/1993 | Nakamura | 248/441.1 |
| 5,284,337 | A | 2/1994 | Ettischer et al. | 271/220 |
| 5,593,151 | A | 1/1997 | Mashtare | 271/193 |
| 6,027,114 | A | 2/2000 | Watanabe et al. | 271/265.01 |
| 6,640,083 | B2 | 10/2003 | Conard-White et al. | 399/377 |
| 6,965,749 | B2 | 11/2005 | Lee | 399/377 |
| 7,050,206 | B2 | 5/2006 | Payne | 358/488 |
| 7,532,851 | B1 * | 5/2009 | King | 399/374 |
| 2004/0089992 | A1 | 5/2004 | Makino | |
| 2004/0173960 | A1 | 9/2004 | Oikawa | |
| 2008/0048381 | A1 | 2/2008 | Mahler | |

OTHER PUBLICATIONS

Lee, US-2005/0169682A1, Aug. 2005.
Kim, Structure for Easely Transforming Folder-Type . . . , Derwent Week Nov. 4, 2004.

* cited by examiner

*Primary Examiner* — Judy Nguyen
*Assistant Examiner* — Justin Olamit
(74) *Attorney, Agent, or Firm* — James D. Welch

(57) ABSTRACT

A system and method for application in single-sheet-feed copiers that automatically tends to the handling of original sheets after they are sequentially and individually placed into the single sheet-feed copier, including depositing the original sheets in a receptacle in a collated manner, without the requirement of direct handling of the original sheets by a user to achieve the collation.

3 Claims, 9 Drawing Sheets

COLLATOR SYSTEM AND METHOD FOR COPY MACHINES

This Application is a CIP of application Ser. No. 11/311,713 Filed Dec. 20, 2005 now U.S. Pat. No. 7,532,851, and Claims benefit from Provisional Application Ser. No. 60/652,810 Filed Feb. 15, 2005.

TECHNICAL FIELD

The present invention relates to copiers and more particularly to system and methodology for application in single-sheet-feed-type copiers that automatically tends to the handling of original sheets after they are individually sequentially placed into the single-sheet-feed copier, including depositing the original sheets in a receptacle in a collated manner without the requirement of direct handling thereof by a user to achieve the collation.

BACKGROUND

Copy machines typically process originals to a separate stack as they are copied without need for a user to handle them. Further, vertically oriented "racks" are often positioned with respect to a copy machine such that while it makes multiple copies of a sheet, the multiple copies are distributed to a like multiple of different rack locations. Using said system multiple copies of a sequential number of original sheets can be made and distributed. This avoids the necessity of a person having to distribute multiple copies into separate stacks in order to arrive at full copies of multiple page originals. And where multiple copies of each sheet are not necessary, such copy machines still offer utility in that the copy is neatly deposited in a stack which is kept separate from the originals.

It is noted that copy machines as just described tend to be expensive. Single sheet copies, while allowing a user to place an original therein and make one or more copies thereof, typically require the user to then remove the original and place it in a stack. The copy or copies usually accumulate at an outlet of the copier and, while not typically collated, can be tended to when convenient. Utility would derive from a system, and method of its use, which would automatically tend to the handling of an original sheet once it is placed into the copier system, such that it would be automatically deposited in an accumulation tray by the action of a user placing another sheet into said single sheet copier.

With the present invention in mind, a Search of Patents was conducted. Though very little was found, Patents identified were:

U.S. Pat. No. 6,027,114 to Watanabe et al. which describes a document transport apparatus;

U.S. Pat. No. 5,022,640 to Greco which describes a static eliminator to aid with paper feeding;

U.S. Pat. No. 4,721,981 to Rauen et al. which describes a low cost document feeder for documents;

U.S. Pat. No. 5,261,634 to Nakamura which describes a structure for a document holder;

U.S. Pat. No. 5,284,337 to Ettischer et al. which describes a sheet depositing device.

References identified by the Examiner in the Examination of application Ser. No. 11/311,713 Filed Dec. 20, 2005 are:

Published Application by Lee, Shih Uang, Filed August 2005;

Patent to Conrad-White, No. 6,640,083.

"Structure For Easily Transforming Folder-type Mobile Telephone Enabling Cover Part to be Rotated by 180 Degrees Up and Down in State in Which the Cover Part is Opened"; Kim, Issued 2004 Nov. 4, Dermet Week 200523.

Additional Patents and Published Applications recently identified are: U.S. Pat. Nos. 7,050,206 to Payne; 6,065,749 to Lee; 5,593,151 to Mashtare; 5,228,373 to Welsch; 5,009,352 to yasada; 4,975,802 to Kasahara; 4,766,515 to Bollen; 3,916,270 to Wachtler; 3,634,740 to Stevko; 3,571,678 to Sezako, US2008/0048381 by Mahler; US2004/0173960 by Oikawa; US2004/0089992 by Makino.

New, Novel and Non-obvious utility would derive from a system, and method of its use, which would automatically tend to the handling of an original sheet once it is placed into the copier system, such that it would be automatically deposited in an accumulation tray by the action of a user placing another sheet into said single sheet copier.

DISCLOSURE OF THE INVENTION

As disclosed in Parent application Ser. No. 11/311,713, known single-sheet-feed copy machines comprise a copy stage and a hinged cover. Said hinged cover allows entry of an original sheet to said copy stage when opened. The present invention provides that in addition, said hinged cover have means for removably securing an original sheet thereto in a controllable manner. In use the hinged cover is opened and an original sheet (of paper) to be copied is placed onto said copy stage and copied, as is common practice. However, the present invention provides that this is followed by said original sheet being, before said hinged cover is re-opened, removably secured thereto in a controllable manner. That is, the original sheet is caused to be removably secured to said hinged cover when it is re-opened. The means for removably securing an original sheet thereto in a controllable manner can be a selection from the group consisting of:

a static electricity producing system; and a vacuum suction producing system.

A method of collating originals sheets which are being copied using a single-sheet-feed copy machine comprises the steps of:

a) providing a single-sheet-feed copy machine comprising a copy stage and a hinged cover, said hinged cover allowing entry of an original sheet to said copy stage when opened, and said hinged cover having means for removably securing an original sheet thereto in a controllable manner, such that in use said hinged cover is opened and a first original sheet to be copied is placed onto said copy stage, followed by said first original sheet being copied and, before said hinged cover is re-opened, said means for removably securing an original sheet thereto in a controllable manner being operated so that when said hinged cover is re-opened said first original sheet is removably secured thereto;

b) opening said hinged cover and placing a first original sheet to be copied onto said copy stage;

c) closing said hinged cover and causing a copy of said first original sheet to be made;

d) activating said means for removably securing an original sheet thereto in a controllable manner so that said first original sheet is caused to be removably secured thereto;

e) re-opening said hinged cover and de-activating said means for removably securing an original sheet thereto in a controllable manner, so that said first original sheet is caused to drop into a receptacle.

Said method can further comprise:

f) placing a second original sheet to be copied onto said copy stage;

g) closing said hinged cover and causing a copy of said second original sheet to be made;

h) activating said means for removably securing an original sheet thereto in a controllable manner so that said second original sheet is caused to be removably secured thereto;

i) re-opening said hinged cover and de-activating said means for removably securing an original sheet thereto in a controllable manner, so that said second original sheet is caused to drop into a receptacle adjacent to said first original sheet in a collated relative position with respect to said first original sheet.

And said method can yet further comprise:

j) placing a second original sheet having front and back sides to be copied onto said copy stage with a front side thereof facing said copy stage;

k) closing said hinged cover and causing a copy of said front side of said first original sheet to be made;

l) activating said means for removably securing an original sheet thereto in a controllable manner so that said first original sheet is caused to be removably secured thereto;

m) partially re-opening said hinged cover and de-activating said means for removably securing an original sheet thereto in a controllable manner, so that said first original sheet is caused to move back onto said copy stage with its back side facing said stage, re-closing said hinged cover and causing a copy of said back side of said first original sheet to be made;

n) re-activating said means for removably securing an original sheet thereto in a controllable manner so that said second original sheet is caused to be removably secured thereto;

o) re-opening said hinged cover and de-activating said means for removably securing an original sheet thereto in a controllable manner, so that said second original sheet is caused to drop into a receptacle adjacent to said first original sheet in a collated relative position with respect to said first original sheet.

Note: An alternative approach to step m above is to provide a clear stage to which an original sheet can be removably secured. Said clear stage can be attached to the copier in a manner such that it can be flipped-over. The procedure would then be to copy the front of the original sheet, then cause the clear stage to which the original sheet is removably secured to flip-over and copy the back side thereof.

Another method of collating original sheets which are being copied using a single-sheet-feed copy machine comprises the steps of:

a) providing a single-sheet-feed copy machine comprising a copy stage and a hinged cover, said hinged cover allowing entry of an original sheet to said copy stage when opened, and said hinged cover having means for removably securing an original sheet thereto in a controllable manner, such that in use said hinged cover is opened and a first sheet to be copied is placed onto said copy stage, followed by said sheet being copied and, before said hinged cover is re-opened, said means for removably securing an original sheet thereto in a controllable manner being operated so that when said hinged cover is re-opened said first original sheet is removably secured thereto;

b) opening said hinged cover and placing a first original sheet having front and back sides to be copied onto said copy stage with a front side thereof facing said copy stage;

c) closing said hinged cover and causing a copy of said front side of said first original sheet to be made;

d) activating said means for removably securing an original sheet thereto in a controllable manner so that said first original sheet is caused to be removably secured thereto;

e) partially re-opening said hinged cover and de-activating said means for removably securing an original sheet thereto in a controllable manner, so that said first original sheet is caused to move back onto said copy stage with its back side facing said stage, re-closing said hinged cover and causing a copy of said back side of said first original sheet to be made;

f) re-activating said means for removably securing an original sheet thereto in a controllable manner so that said second original sheet is caused to be removably secured thereto;

i) re-opening said hinged cover and de-activating said means for removably securing an original sheet thereto in a controllable manner, so that said second original sheet is caused to drop into a receptacle.

Said method can further comprise:

i) placing a second original sheet to be copied onto said copy stage;

k) closing said hinged cover and causing a copy of said second sheet to be made;

l) activating said means for removably securing an original sheet thereto in a controllable manner so that said second original sheet is caused to be removably secured thereto;

m) re-opening said hinged cover and de-activating said means for removably securing an original sheet thereto in a controllable manner, so that said second original sheet is caused to drop into a receptacle adjacent to said first original sheet in a collated relative position with respect to said first original sheet.

It should be appreciated that a user need not directly tend to handling an original sheet once it is entered into the copier. Simply operating a hinged cover in conjunction with activating and deactivating said means for removably securing an original sheet thereto in a controllable manner automatically handles said original sheets and causes them to be deposited in a collated manner.

Another method of collating original double sided original sheets which are being copied using a single-sheet-feed copy machine comprises the steps of:

a) providing a single-sheet-feed copy machine comprising a copy stage and a hinged cover, said hinged cover allowing an original sheet entry to said copy stage, and said hinged cover having means for removably securing an original sheet thereto in a controllable manner, said hinged cover being constructed and secured to said copy machine so that it can be rotated 180 degrees so that either side of a double sided original sheet can be caused to face said copy stage, such that in use a first sheet to be copied is placed onto said hinged cover and a first side thereof is positioned to face copy stage, followed by said hinged cover being rotated by 180 degrees and positioned it so that the opposite side of said original sheet can be copied;

b) placing a first original sheet to be copied into said hinged cover such that a first side thereof faces the copy stage and causing a copy thereof to be made;

c) causing said hinged cover to be rotated 180 degrees;

d) causing the opposite side of said original sheet to face said copy stage and causing a copy of thereof to be made.

It is noted that the hinged cover can comprise a transparent element to which an original sheet can be removably secured, or can be of multiple piece construction which allows separation of the pieces and the positioning of an original sheet therebetween.

The present Application further discloses a single-sheet-feed copy machine comprising:

- a non-horizontally oriented copy stage with higher and lower sides; and
- a hinged cover, said hinged cover having a lip structure which serves as a stop at the lower side of said non-horizontally oriented copy stage when said hinged cover is partially opened, but does not serve as a stop when said hinged cover is more substantially opened, said hinged cover optionally having means for removably securing an original sheet thereto in a controllable manner;

a substantially vertically oriented receptacle for receiving original sheets once copied.

In use said single-sheet-feed copy machine allows an original sheet to be entered to said copy stage when said hinged cover is partially opened, such that in use said hinged cover is partially opened and an original sheet to be copied is placed onto said copy stage and is stopped at the lower side thereof by the hinged cover lip structure. This is followed by said hinged cover being closed and said original sheet being copied, and further followed by said hinged cover being more substantially opened so that said original sheet slides off the copy stage and into said substantially vertically oriented receptacle for receiving original sheets.

Said single-sheet-feed copy machine can specifically comprise means for removably securing an original sheet thereto in a controllable manner as described above. In use, it is then possible to, before said hinged cover is more substantially opened after said original sheet is copied, operated said means for removably securing an original sheet thereto in a controllable manner, so that when said hinged cover is more substantially opened said original sheet is caused to be removably secured thereto. Said means for removably securing an original sheet thereto in a controllable manner can be a selection from the group consisting of:

a static electricity producing system; and a vacuum suction producing system.

A method of collating originals sheets which are being copied using a single-sheet-feed copy machine then comprises the steps of:

a) providing a single-sheet-feed copy machine as described above;

b) partially opening said hinged cover and placing a first original sheet to be copied onto said copy stage such that said original sheet is stopped by the hinged cover lip at the lower side thereof;

c) closing said hinged cover and causing a copy of said first original sheet to be made;

d) more substantially opening said hinged cover such that said original sheet is not stopped by the hinged cover lip at the lower side thereof, such that said original sheet slides into said substantially vertically oriented receptacle for receiving original sheets.

It is noted that a non-horizontally oriented copy stage with higher and lower sides serves to assure that a sheet of paper placed thereinto will reliably be positioned at the lower side thereof when a copy is made thereof.

Said method can involve, before step d, activating said means for removably securing an original sheet thereto in a controllable manner so that said first original sheet is caused to be removably secured thereto; then re-opening said hinged cover and de-activating said means for removably securing an original sheet thereto in a controllable manner, so that said first original sheet is caused to drop into said substantially vertically oriented receptacle.

The present invention will be better understood by reference to the Detailed description Section of this Specification in conjunction with the Drawings.

DETAILED DESCRIPTION

Figure 1:
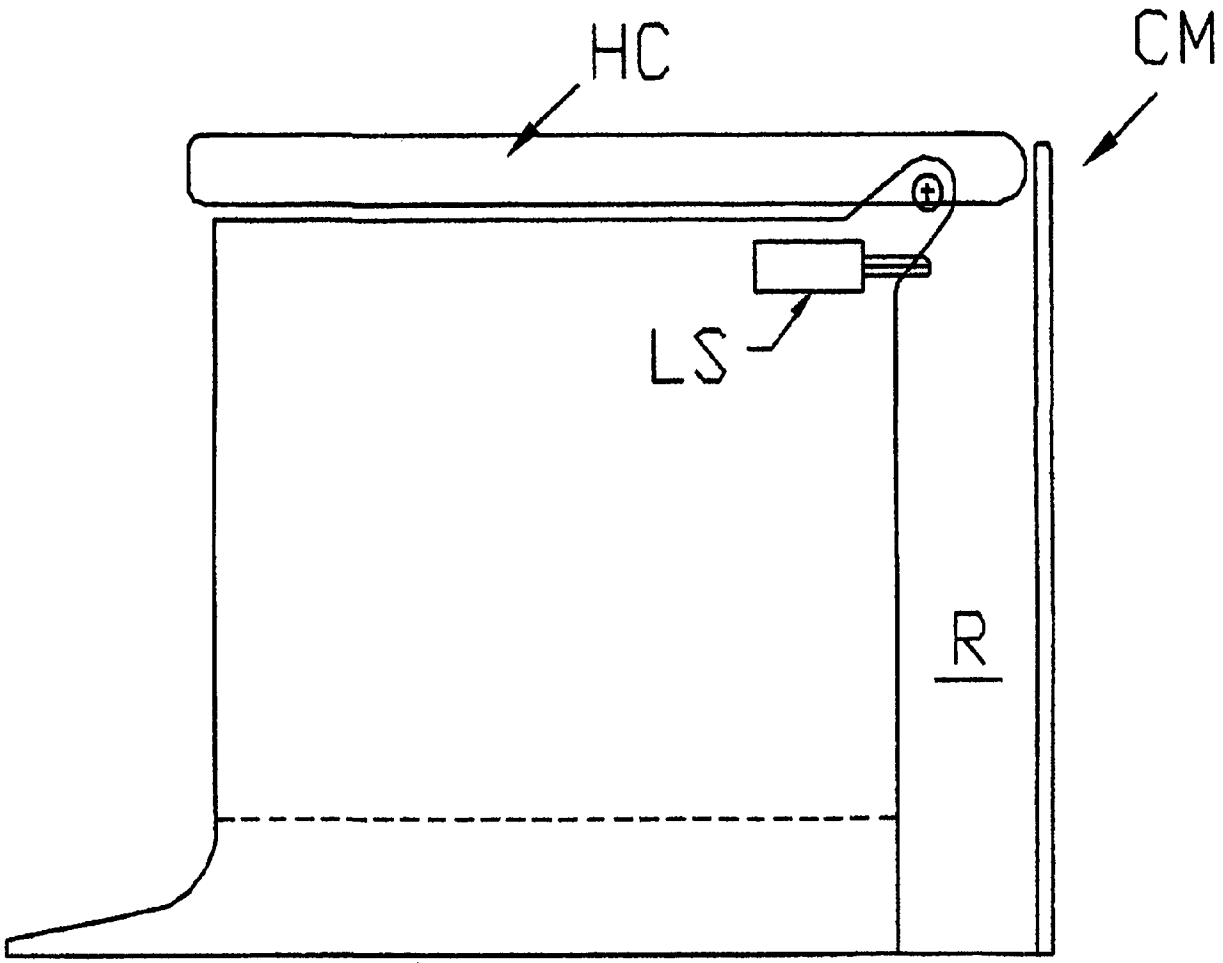
FIG. 1 shows a single-sheet-feed copy machine with a hinged cover, and showing a vertically oriented receptacle to receive original sheets.
Figure 2:
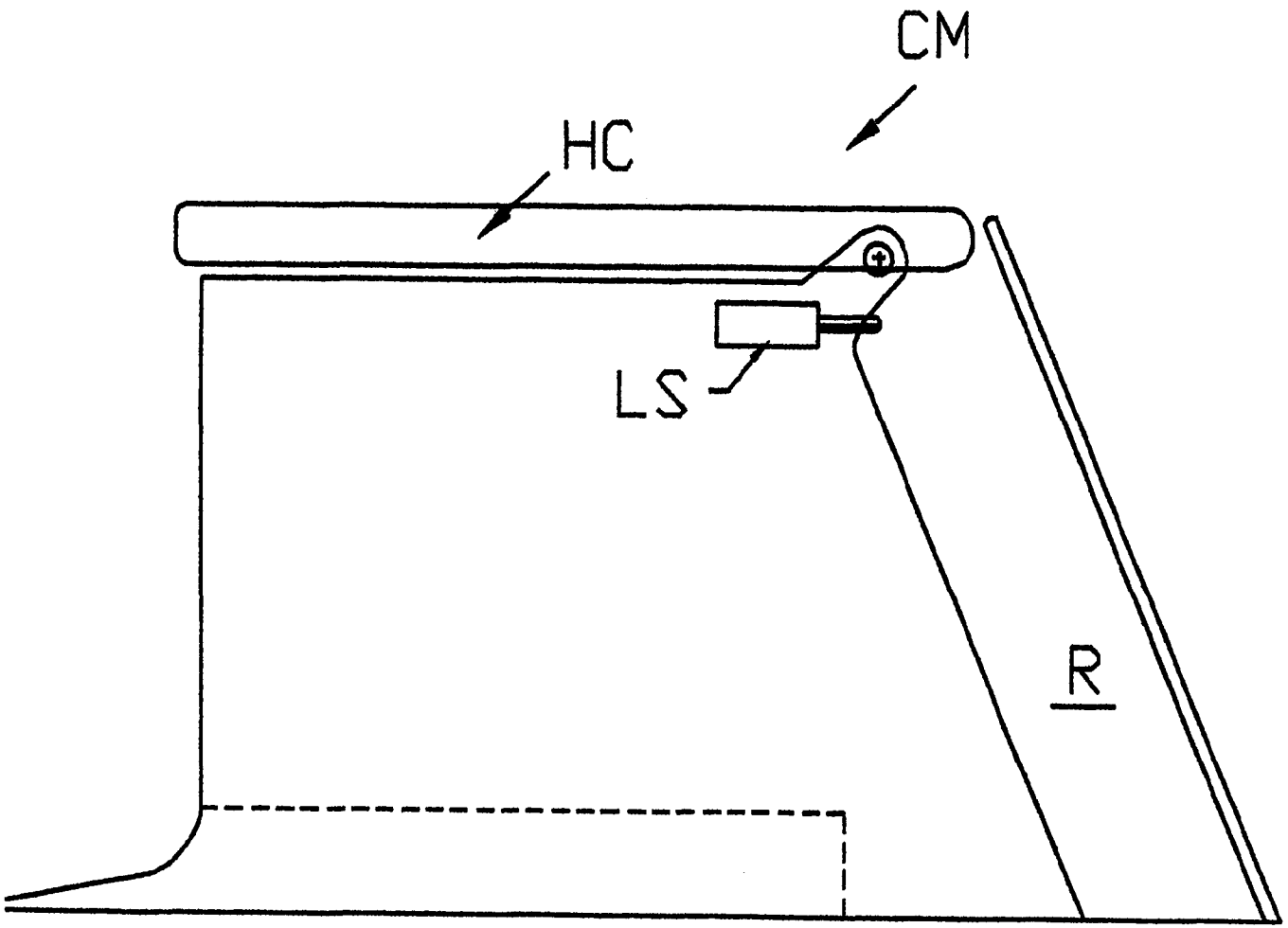
FIG. 2 shows a single-sheet-feed copy machine with a hinged cover, and showing an angle oriented receptacle to receive original sheets.
Figure 3A:
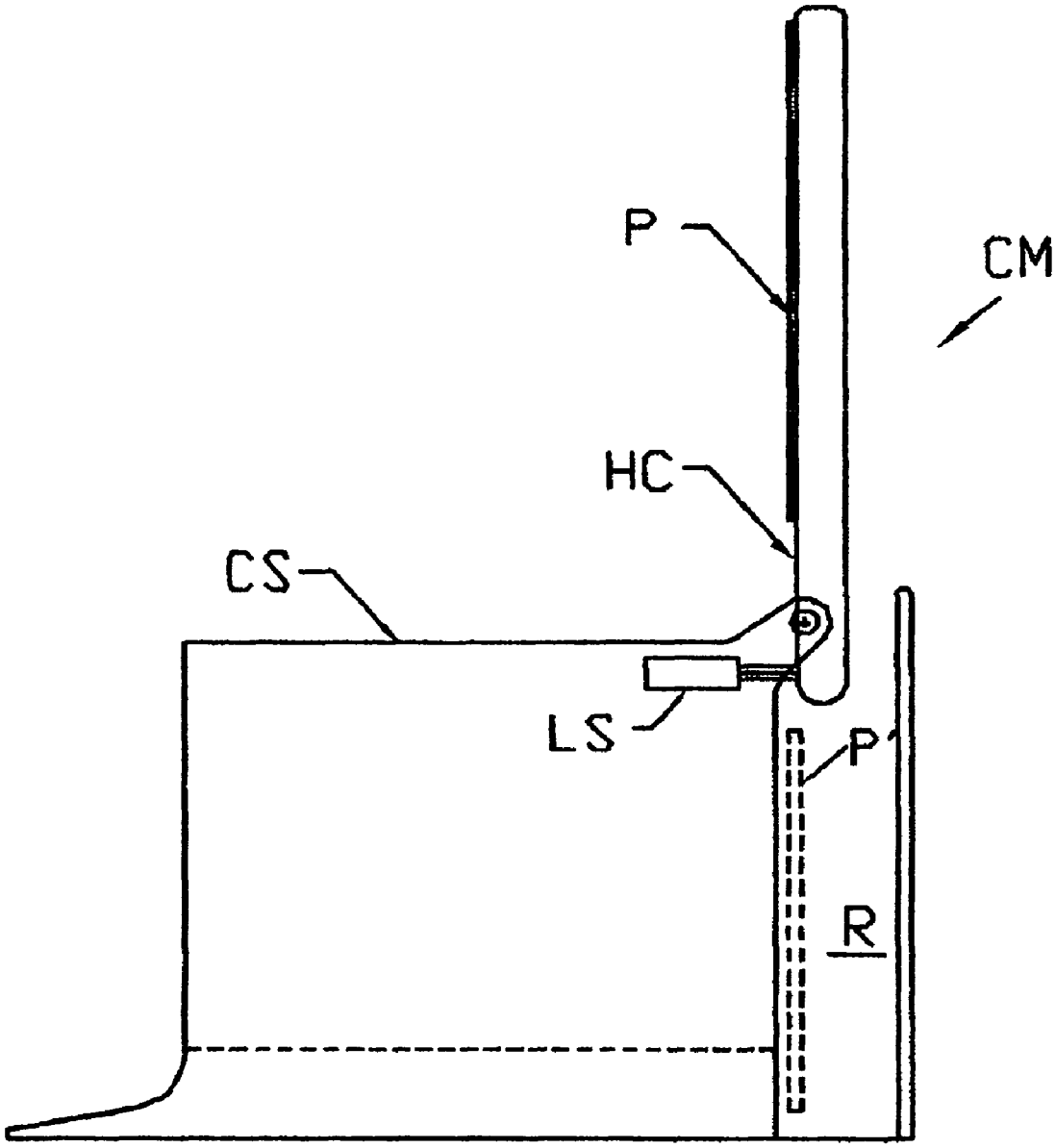
FIG. 3*a* shows the single-sheet-feed copy machine of FIG. 1 with the hinged cover rotated into position to drop an original sheet into the receptacle.
Figure 3C:
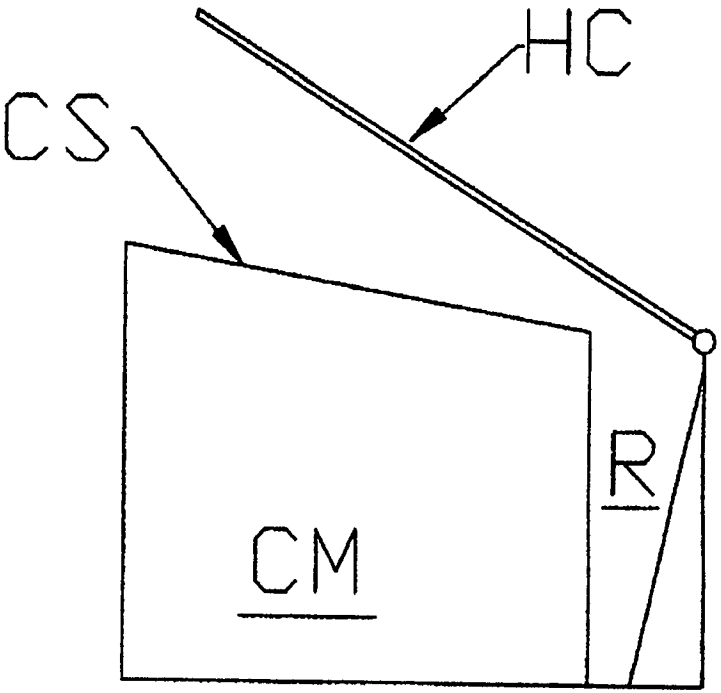
FIGS. 3*b* and 3*c* show a system similar system to that in FIG. 3*a*, but with a non-horizontally oriented stage (CS).
Figure 3B:
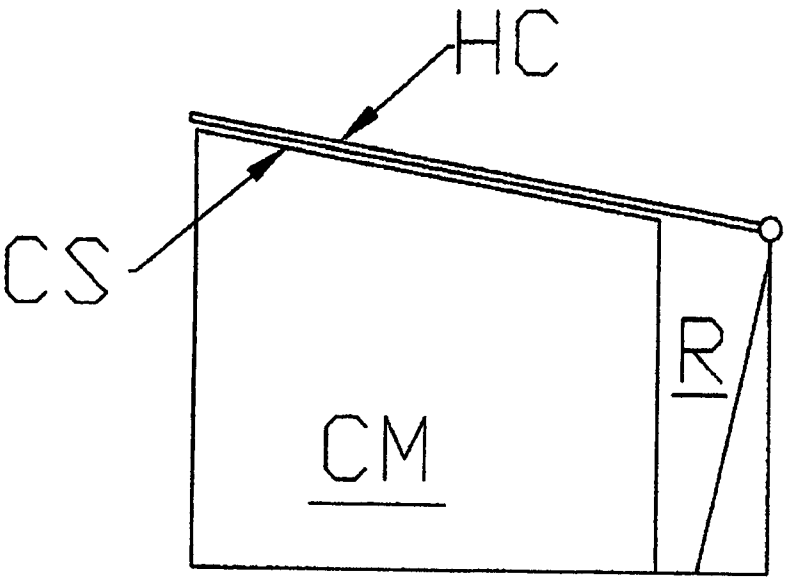

Turning now to the Figures, FIG. 1 shows a single-sheet-feed copy machine (CM) with a hinged cover (HC), and showing a substantially vertically oriented receptacle (R) to receive original sheets (P). FIG. 2 shows a single-sheet-feed copy machine (CM) with a hinged cover (HC), and showing an angle oriented receptacle (R) to receive original sheets. FIG. 3*a* shows the single-sheet-feed copy machine (CM) of FIG. 1 with the hinged cover (HC) rotated into position to drop an original sheet (P) into the receptacle, (shown as (P')). In use said hinged cover (HC) is opened and a first original sheet (P) to be copied is placed onto said copy stage (CS), followed by said first original sheet being copied and, before said hinged cover (HC) is re-opened, said means for removably securing an original sheet thereto in a controllable manner being operated so that when said hinged cover (HC) is re-opened said first original sheet is removably secured thereto. Releasing the effect of said means for removably securing an original sheet to said hinged cover (HC) causes said first original sheet to drop into the position indicated by (P') in the receptacle (R). Of course the procedure can be repeated for second and third etc. original sheets and when they are released into the receptacle (R), they will be collated in proper order. Note that operation of the limit switch (LS) in FIG. 3*a* can be assumed to operate the means for removably securing an original sheet thereto in a controllable manner to release the original sheet (P) so that it drops to position (P'). FIGS. 3*b* and 3*c* show a similar system to that in FIG. 3*a*, but with a non-horizontally oriented stage (CS).

Figure 4B:
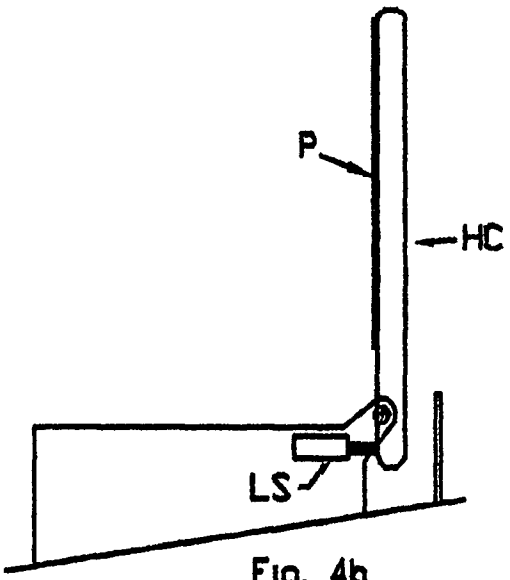
FIGS. 4*a*-4*d* demonstrate a sequence of operation of a hinged cover to flip an original sheet over.
Figure 4C:
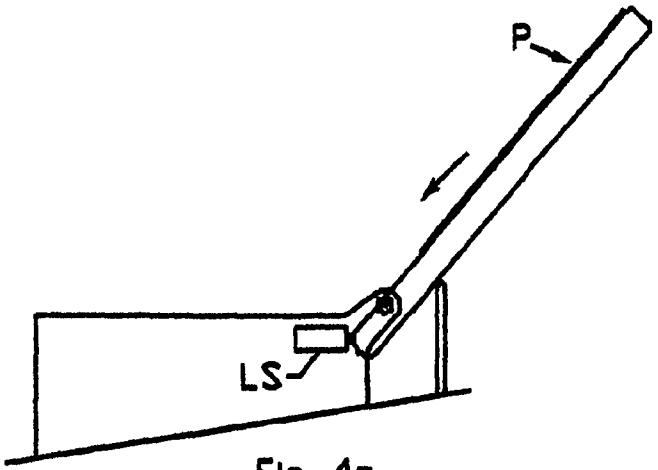
Figure 4A:
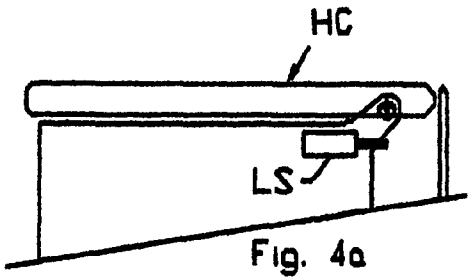
Figure 4D:
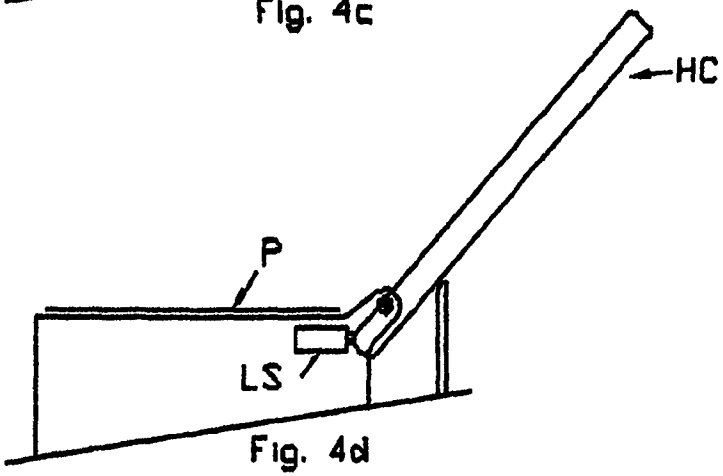

FIGS. 4*a*-4*d* demonstrate a sequence of operation of a hinged cover (HC) to flip an original sheet over. The sequence should be assumed to begin with the placing of an original sheet, which has first and second sides, on the copy stage (CS) of the single-sheet-feed copy machine (CM) and the copying of the first side thereof facing the copy stage (CS). FIG. 4*a* can be interpreted to represent this condition. This is followed by operation of said means for removably securing an original sheet thereto in a controllable manner being operated so that when said hinged cover (HC) is re-opened said first original sheet is removably secured thereto. The results of this are shown in FIG. 4*b*. FIG. 4*c* shows that the hinged cover is rotated to provide a sloped surface. When the means for removably securing an original sheet thereto in a controllable manner is operated to release the original sheet (P), FIG. 4*d* shows that said original sheet slides onto the copy stage with its second side facing the copy stage. Note that operation of the limit switch (LS) in FIG. 4*c* can be assumed to operate the means for removably securing an original sheet thereto in a controllable manner to release the original sheet (P). This can comprise turning off a static electricity producing system or a vacuum suction producing system or other means for removably securing an original sheet.

Figure 5A:
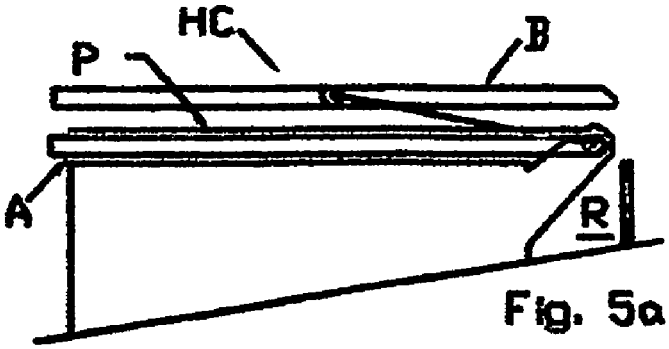
FIGS. 5*a*-5*c* show a sequence of positioning an original sheet into a two section hinged cover, copying it and positioning it to be dropped into a vertically oriented receptacle.
Figure 5B:
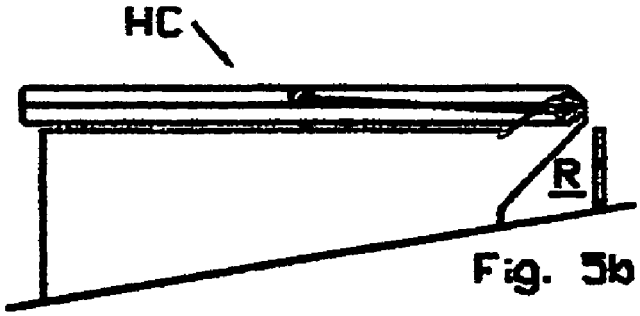
Figure 5C:
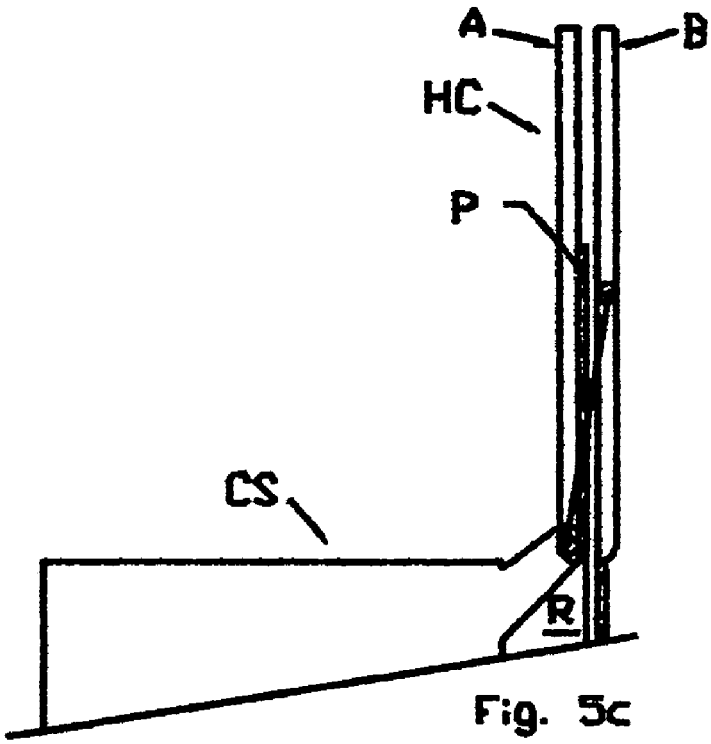

FIGS. 5*a*-5*c* show a sequence of positioning an original sheet into a two section (A) (B) hinged cover (HC), copying it and positioning it to be dropped into a substantially vertically oriented receptacle (R). FIG. 5*a* shows a two element hinged cover (HC) which is opened to allow entry of an original sheet (P) therein. FIG. 5*b* shows the hinged cover (HC) securing the original sheet (P) in position for making a copy thereof. FIG. 5*c* shows the hinged cover (HC) opened and positioned to drop the original sheet (P) into the substantially vertically oriented receptacle (R).

Figure 6A:
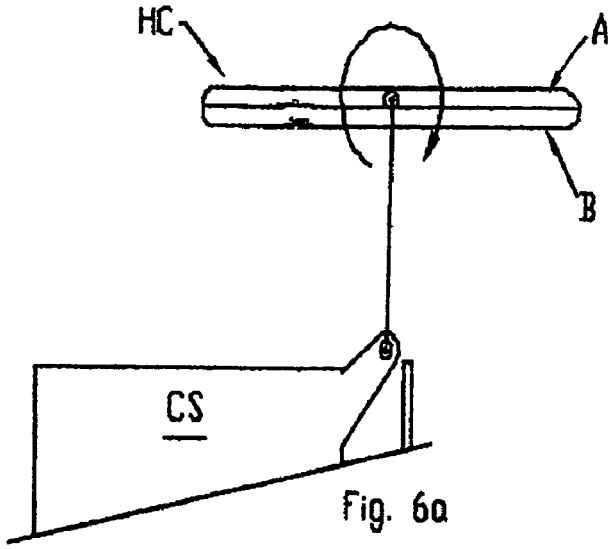
FIGS. 6*a*-6*c*, in combination with FIGS. 5*a* and 5*b* show a sequence like that in FIGS. 5*a*-5*c*, but including a mechanical approach to flipping an original sheet over and then positioning it to be copied.
Figure 6B:
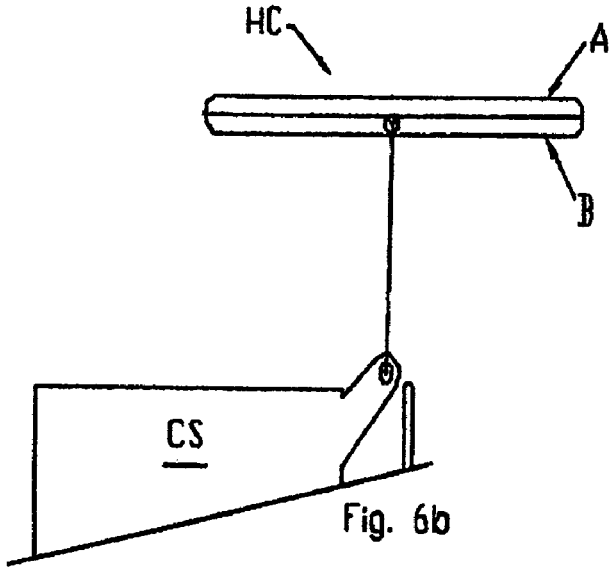
Figure 6C:
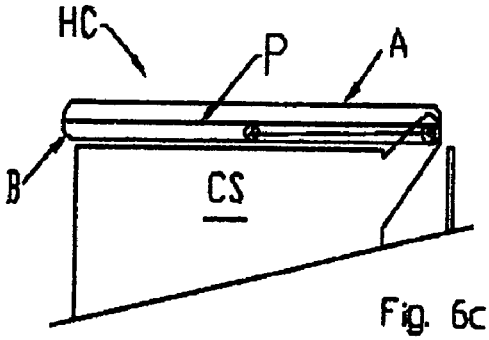

FIGS. 6*a*-6*c*, in combination with FIGS. 5*a* and 5*b* show a sequence like that in FIGS. 5*a*-5*c*, but including a mechanical approach to flipping an original sheet (P), over and then positioning it to have its back side copied. Again, FIG. 5*a* shows a two element hinged cover (HC) which is opened to allow entry of an original sheet (P) therein. FIG. 5*b* shows the hinged cover (HC) securing the original sheet (P) in position for making a copy of the first side thereof. FIG. 6*a* shows the hinged cover positioned to allow its rotation by 180 degrees. FIG. 6*b* shows the hinged cover rotated by 180 degrees and FIG. 6*c* shows the hinged cover (HC) in place to allow making a copy of the opposite side of the original sheet (P). It is to be noted that while the hinged cover (HC) in FIGS. 5*a*-6*c* is shown as being comprised of two pieces (A) (B), it can comprise a transparent sheet to which an original sheet is removably secured.

Figure 7B:
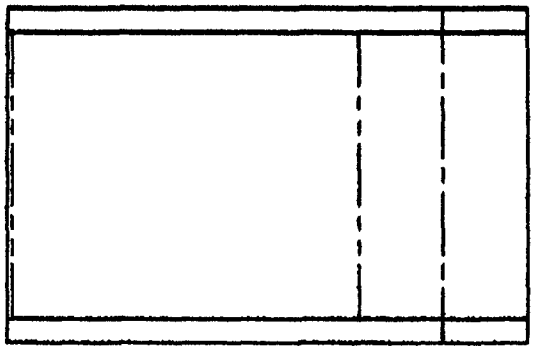
FIGS. 7*a*-7*d* show a variation on the single-sheet-feed copy machine, comprising an non-horizontally oriented copy stage.
Figure 7A:
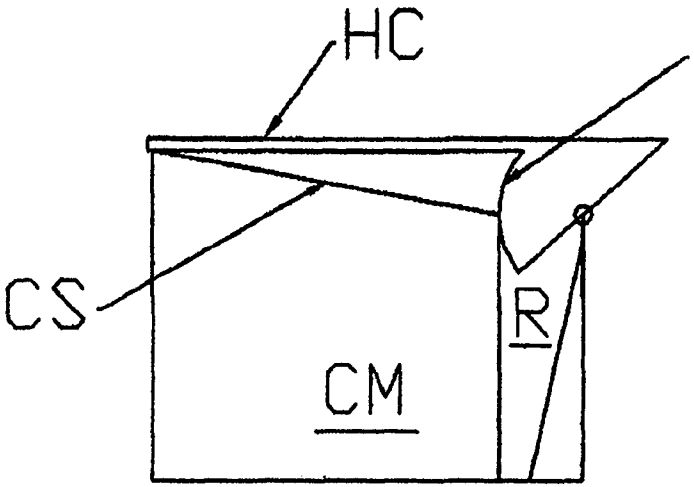
Figure 7D:
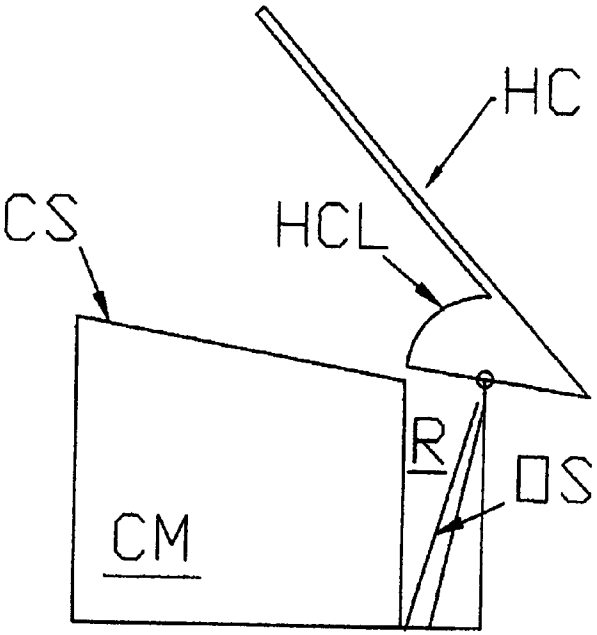
Figure 7C:
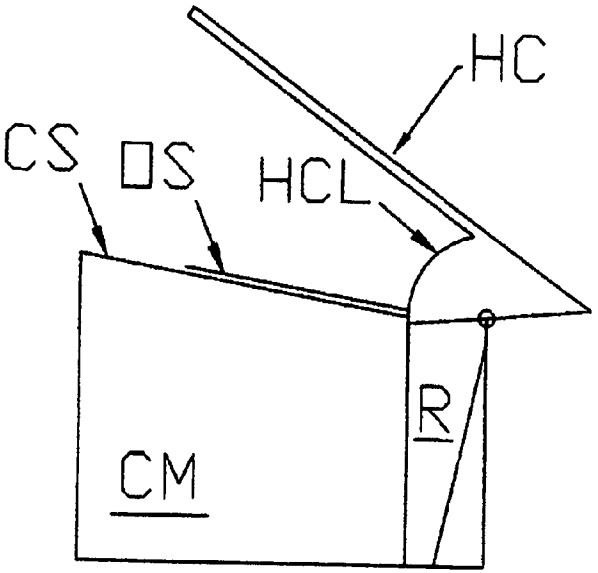

FIGS. 7*a*-7*d* show a variation on the single-sheet-feed copy machine (CM) comprising a non-horizontally oriented copy stage (CS). The basic inventive structure is disclosed in FIG. 7*a*, which shows the copy machine (CM) having a non-horizontally oriented copy stage copy stage (CS), a hinged cover (HC) and a substantially vertically oriented receptacle (R). FIG. 7*b* shows a top view of FIG. 7*a*. FIG. 7*c* shows that the shape of the hinged cover (HC) is such that when it is partially opened an original sheet (OS) to be copied can be placed onto the copy stage (CS), such that it naturally slides into place. That is, said original sheet (OS) slides to contact the hinged cover lip (HCL). The hinged cover (HC) can then be closed and a copy of the original sheet made, followed by opening the hinged cover (BC) more fully opened as shown in FIG. 7*d*. Note that in FIG. 7*d* the hinged cover lip (HCL) no longer serves as a stop to the original sheet (OS) as it did in FIG. 7*c*. As a result the original sheet (OS) is free to slide off the non-horizontally oriented copy stage (CS) and into the substantially vertically oriented receptacle (R), wherein consecutive original sheets will become collated.

It is specifically stated that the embodiments of FIGS. 1-6*c* can also comprise a non-horizontally oriented copy stage (CS) and a hinged cover (HC) having a lip (HCL), as shown in FIGS. 7*a*-7*d*.

Having hereby disclosed the subject matter of the present invention, it should be obvious that many modifications, substitutions, and variations of the present invention are possible in view of the teachings. It is therefore to be understood that the invention may be practiced other than as specifically described, and should be limited in its breadth and scope only by the Claims.

I claim:

1. A method of copying on first and second sides of a sheet of paper using a single-sheet-feed copy machine comprising the steps of:

a) providing a single-sheet-feed copy machine comprising a copy stage and a hinged cover which is substantially rigid, said hinged cover allowing an original sheet entry to said copy stage when opened, and said hinged cover having means for removably securing an original sheet thereto in a controllable manner other than by friction and means for releasing an original sheet secured to said hinged cover by said means for removably securing an original sheet thereto;

such that in use said hinged cover is opened and an original sheet to be copied is placed onto said copy stage with the first side thereof facing said copy stage, followed by said first side original sheet being copied and, before said hinged cover is re-opened, said means for removably securing an original sheet thereto in a controllable manner being operaterable such that when said hinged cover is re-opened said original sheet can be removably secured thereto;

said single-sheet-feed copy machine further comprising a receptacle for collecting a plurality of copied sheets in a collated manner;

said method further comprising:

b) opening said hinged cover and placing an original sheet to be copied onto said copy stage with a first side thereof facing said copy stage;

c) closing said hinged cover so that it projects substantially parallel to said copy stage, and causing a copy of said first side of said sheet to be made;

d) activating said means for removably securing an original sheet thereto in a controllable manner so that said original sheet is caused to be removably secured thereto;

e) re-opening said hinged cover past a substantially vertical orientation with respect to said copy stage so that it slopes downward toward said copy stage, and de-activating said means for removably securing an original sheet thereto in a controllable manner so that said original sheet is caused to move onto said copy stage with its second side facing said copy stage, f) re-closing said hinged cover so that it projects substantially parallel to said copy stage, and causing a copy of said second side of said original sheet to be made;

g) re-activating said means for removably securing an original sheet thereto in a controllable manner so that said original sheet is caused to be removably secured thereto;

h) re-opening said hinged cover so that it projects substantially perpendicular to the copy stage, and de-activating said means for removably securing an original sheet thereto in a controllable manner.

2. A method as in claim 1 wherein practice of step h releases said original sheet into said receptacle.

3. A method as in claim 2 wherein said method further comprises repeating at least steps b, c, d and h for a second original sheet of paper with the result being that both original sheets are caused to be present in said receptacle in a collated manner.

* * * * *